United States Patent [19]

Davis

[11] Patent Number: 4,843,839

[45] Date of Patent: Jul. 4, 1989

[54] POSITIONABLE ECONOMIZER

[75] Inventor: James A. Davis, Franklin, Tenn.

[73] Assignee: American Standard Inc., New York, N.Y.

[21] Appl. No.: 145,354

[22] Filed: Jan. 19, 1988

[51] Int. Cl.[4] ..... F24F 1/02

[52] U.S. Cl. ..... 62/326; 98/34.6; 98/38.6

[58] Field of Search ..... 98/34.6, 34.5, 38.4, 98/38.5, 38.6; 237/46, 53; 62/427, 326

[56] References Cited

U.S. PATENT DOCUMENTS

| | | | |
|---|---|---|---|
| 1,364,894 | 1/1921 | Shurileff | 237/46 |
| 1,497,031 | 6/1924 | Shurtleff . | |
| 2,043,561 | 6/1936 | Sims | 98/38.7 |
| 2,853,934 | 9/1958 | Hohmann | 98/13 |
| 3,570,387 | 3/1971 | Eggers | 98/106 |
| 4,480,533 | 11/1984 | Bolton et al. | 98/38 |
| 4,491,270 | 1/1985 | Brand | 236/49 |
| 4,657,478 | 4/1987 | LaZebnik et al. | 415/126 |
| 4,759,196 | 7/1988 | Davis | 98/34.6 |

*Primary Examiner*—Henry A. Bennet

*Attorney, Agent, or Firm*—William J. Beres; David L. Polsley; Robert J. Harter

[57] ABSTRACT

An economizer for an air handler, air conditioner or similar unit. The economizer has a first position and a second position. In the first position, the economizer is retracted and presents a relatively flat end surface of the air handler, and in a second position the economizer projects from the air handler and provides for the intake of ambient air into the air handler. The invention provides for the shipment of the economizer intact with the air handler so that installation of the unit is conveniently achieved.

10 Claims, 3 Drawing Sheets

POSITIONABLE ECONOMIZER

TECHNICAL FIELD

This invention pertains generally to the field of air handling enclosures and specifically to the ambient air intake economizer for air conditioning units and other air handling enclosures.

BACKGROUND ART

A typical economizer as is known and presently used provides an air intake for a flow of ambient air through an air handling enclosure, or air handler, to provide, for example, free-cooling or make-up air for an air conditioning system.

In a typical economizer installation, a wall of an air handling enclosure on which an economizer assembly is to be employed is removed and an economizer assembly is substituted in its place. This substitution typically requires considerable time and labor. After the economizer assembly is substituted in place of the end panel, it must also be weatherproofed and sealed to provide proper operation. Further, the typical economizer assembly must be shipped separately, which introduces the additional risk of loss, damage and other casualty to the economizer assembly.

Alternatively, the air handling enclosure is shipped for installation with the economizer assembly in place, which permits factory installation and weatherproofing of the economizer assembly. However, the typical economizer, when in place, projects from the air handler and requires the exercise of great care in packing and protecting the economizer end of the air handler. This results in extraordinary shipping and installation costs and difficulties, while often not providing adequate protection of the economizer from damage. Both methods therefore carry inherent risks of delay and expense in the installation of the economizer.

Thus, it is an object of the invention to provide an economizer assembly which is shipped integrally with the air handler or similar unit.

It is a further object of the invention to provide an economizer assembly which provides convenient and inexpensive setup at time of installation of an air handling enclosure.

A still further object is to provide an economizer assembly which is relatively less susceptible to loss or damage in shipment.

Yet a still further object is to provide an economizer assembly which gives the foregoing benefits at the lowest possible cost of manufacture, time, and effort.

These and other objects of the invention will become apparent from the attached drawings and the description of the preferred embodiment that follows hereinafter.

SUMMARY OF THE INVENTION

The subject invention is an economizer assembly used in air handling enclosures, such as air conditioner or similar units having an end thereon through which ambient air intake is required for free-cooling or make-up air in an air handling or air conditioning system. The economizer has a first position in which it cooperates with a wall of the air handler or similar unit to comprise a relatively flat surface for ease of shipment, and an operative second position such that ambient air may be taken into the air handler or similar unit.

DESCRIPTION OF THE PREFERRED EMBODIMENT

Figure 1:
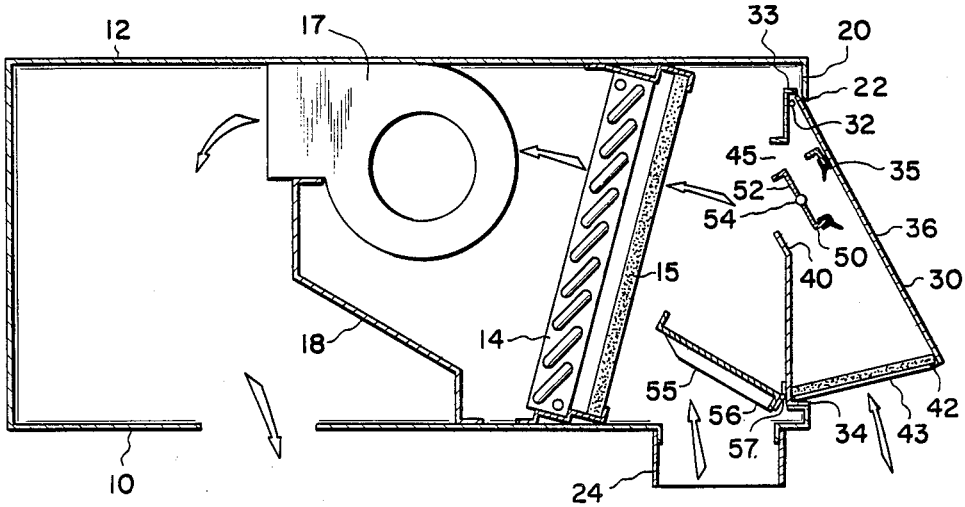
FIG. 1 shows a cross-sectional view of an air handling unit with the economizer of the present invention in a second position.

An air handler unit for an air conditioning system is generally denoted by reference numeral 10 as shown in FIG. 1. Air handler unit 10 is of the type commonly found in central air conditioning systems having a ductwork system providing conditioned air to a number of rooms or conditioned spaces, and a ductwork system for returning air from the rooms or conditioned spaces to the air handler unit to be conditioned therein. Typically, the ductwork system is installed above a false ceiling over the rooms or conditioned spaces and below the roof or ceiling, as the case may be, above the false ceiling. The air handler unit 10 is then installed in connection with the ductwork system immediately above the ductwork system or upon the roof of the structure. The details of the cooperation between the ductwork system and the air handler unit 10 are not shown, as it is believed that the state of the art of the ductwork system is well understood and that further description thereof is not necessary to understand the form and function of the subject invention.

Figure 2:
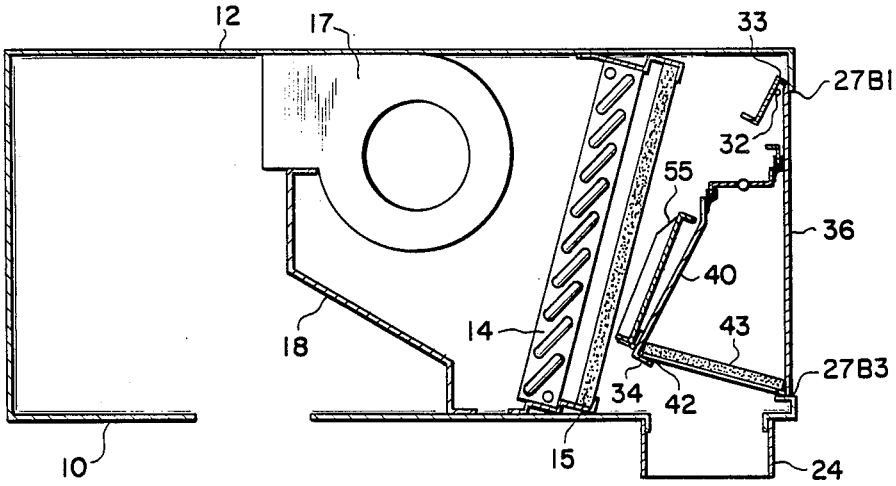
FIG. 2 shows a cross-sectional view of an air handling unit with the economizer in a first position.

The air handler unit 10, as shown in FIGS. 1 and 2, consists generally of an enclosure 12 with a heat exchanger coil 14 disposed therein. A filter 15 and a centrifugal fan 17 are located on opposite sides of the heat exchanger coil 14. A partition 18 joins centrifugal fan 17 to enclosure 12 to create an air directing channel, whereby supply air is drawn through the filter 15 and heat exchange coil 14 by fan 17 and then directed from enclosure 12 into the ductwork system and to the conditioned spaces. The supply air is drawn through an economizer assembly aperture 22 or a return air intake 24 prior to being drawn through filter 15 by the fan 17.

Figure 3:
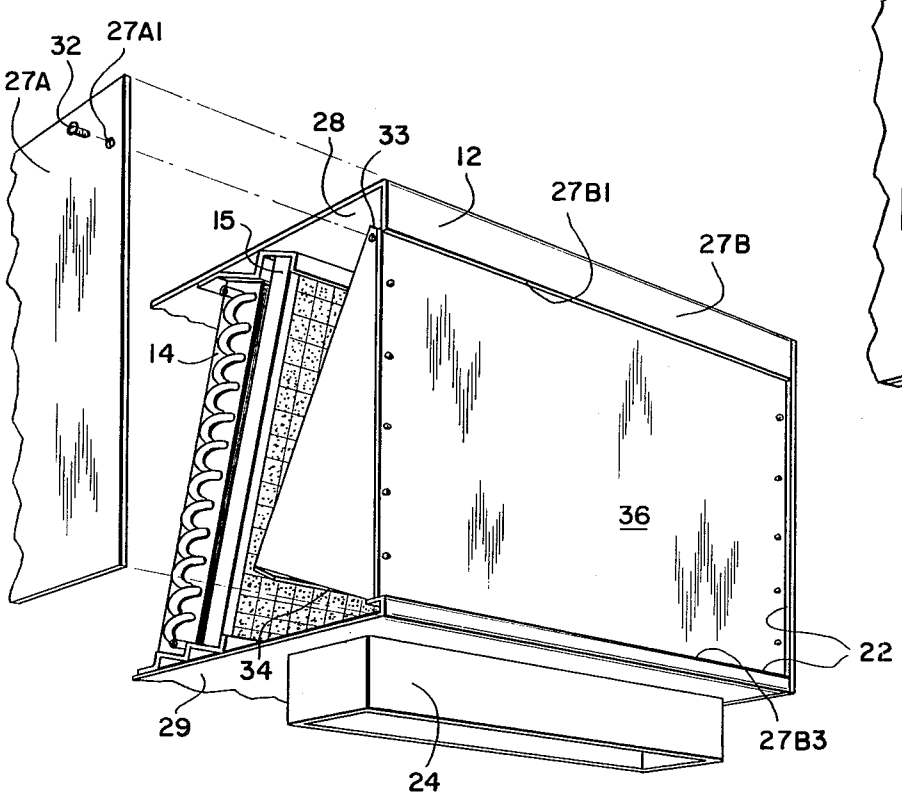
FIG. 3 shows an exploded partial perspective view of the economizer in a first position.

Turning briefly to FIG. 3, the enclosure 12 is shown with one wall 27A removed to show the interior of the air handling unit 10. A second wall 27B is shown with an economizer assembly 30 mounted therein. The enclosure top 28 and enclosure bottom 29 are also shown in their respective position on the enclosure 12.

The economizer assembly 30 permits free-cooling, whereby cooling of the conditioned spaces in the structure is accomplished by the intake of cool ambient air through the economizer assembly 30. When this cool ambient air is available, no mechanical cooling of the supply air need be performed. It is also possible to obtain make-up air through the economizer assembly 30. This replaces, or makes-up for, the loss of air incurred by leakage in the structure. Exhausting air from the structure for purging the conditional spaces is an additional function of the economizer assembly 30. This is accomplished, for example, by reversing the rotation of fan 17 or by providing air directing dampers to direct return air out through the economizer assembly 30.

These uses of an economizer assembly such as the economizer assembly 30 are illustrative and not to be taken as limiting.

Referring now to FIGS. 1 through 4 generally, the economizer assembly aperture 22 is shown defined in a wall 27B of enclosure 12 for accepting the economizer assembly 30. Preferably, the economizer assembly aperture 22 is defined in wall 27B by a plurality of edges, for example, a rectangular assembly aperture defined by four linear edges.

A means for pivotally mounting the economizer assembly 30 is located adjacent one edge, preferably the top edge 27B1, of the assembly aperture 22. This pivotal mounting means is preferably one or more pivot pins 32, which may be a bolt or a screw, extending through an aperture 27A1 in wall 27A and into the economizer assembly 30 in a pivotally securing manner. The economizer assembly 30 may be pivoted on pivot pin 32 to a first or closed position, with at least a portion of the economizer assembly 30 accepted into the interior of the air handler unit 10, and to a second or open position to permit economizer operation of the air handler unit 10.

The economizer assembly 30 has a proximate end 33 adjacent said top edge 27B1 for pivotal mounting to the enclosure 12, a distal end 34 directly removed therefrom for cooperating with a bottom edge 27B3 of wall 27B, and two opposite sides extending between the proximate end 33 and distal ends 34 of the economizer assembly 30. More particularly, the economizer assembly 30 includes a generally planar exterior wall comprising a hood member 36 extending from the proximate end 33 to the distal end 34 of the economizer assembly 30 and further extending between the sides of the economizer assembly 30. When the economizer assembly 30 is in the first position, the hood 36 is generally coplanar with the wall 27B and extends across the assembly aperture 22 in a covering manner.

The opposite sides of the economizer assembly 30 are in the preferred embodiment more particularly described as side closure members 38 affixed to the hood 36 and extending into the assembly aperture 22 in a manner generally perpendicular to the hood 36 so as to project into the interior of the enclosure 12 in the first position. Each side closure member 38 is generally triangular in shape, with the base of the triangle at the distal end 34 of the economizer assembly 30 and then narrowing toward the proximate end 33.

An assembly interior wall 40 extends between side closure members 38 to complete an enclosed economizer assembly 30. The assembly interior wall 40 and the hood 36 are thus relatively narrowly spaced at the proximate end 33 and widely spaced at the distal end 34 of the economizer assembly 30 by the triangularly shaped side closure members 38.

Each of the side closure members 38, the hood 36 and the assembly interior wall 40 have a distal end corresponding generally to the distal end 33, and a proximate end corresponding generally to the proximate end 34 of the economizer assembly 30. The respective distal ends of the side closure members 38, the hood 36, and the assembly interior wall 40 together comprise a rectangular economizer inlet 42. The assembly interior wall 40, the hood 36 and the side closure members 38 cooperate to define a passage for accepting a flow of air through the economizer assembly 30 from the economizer inlet 42.

An economizer filter 43 extends across economizer inlet 42 in an air filtration manner for filtering air admitted through economizer inlet 42. The economizer filter 43 may be retained in economizer inlet aperture 42 by means of a lip extending about economizer inlet aperture 42, for example, or by bolts or screws.

A damper aperture 45 is provided in assembly interior wall 40, for accepting a primary damper blade assembly 50 thereacross. Primary damper blade assembly 50 consists of a primary damper blade 52 pivotally mounted at hinge 54 and positioned to selectively cover damper aperture 45. A damper actuator (not shown) is connected to the primary damper blade 52 for driving the primary damper blade 52 between a closed position, covering damper aperture 45, and to an open position, opening damper aperture 45 and permitting a flow of air through damper aperture 45 from economizer assembly 30 at a predetermined rate according to the position of the primary damper blade 52.

A secondary damper blade assembly 55 consisting of secondary damper blade 56 pivotally mounted at hinge 57 is positioned to selectively cover the return air intake 24. A secondary damper actuator (not shown) is connected to the secondary damper blade 56 for driving the secondary blade 56 between a closed position, for preventing air flow through the return air intake 24, and an open position for permitting an air flow through the return air intake 24.

Preferably, the secondary damper blade 56 is driven closed as the primary damper blade 52 is driven open. This configuration will then cause the fan 17 to draw supply air primarily or entirely through the economizer assembly 30 into the enclosure 12. Likewise, for drawing supply air primarily or entirely from the return air intake 24, the secondary damper blade 56 is driven open and the primary damper blade 52 is driven closed. The primary damper blade 52 and the secondary damper are cooperatively driven to open and closed positions and to positions between open and closed. By virtue of this cooperation, ambient air is admitted through the economizer assembly 30 in a proportion to the return air admitted through the return air inlet 24 which is consistent with the most energy efficient operation of the air handler unit 10. Further details of the damper blade assemblies and the damper drive actuators are not disclosed, as it is felt that such are well understood.

The first position of the economizer assembly 30 is clearly shown in FIG. 2. In the first position, at least a portion of the economizer assembly 30 is closely received into the enclosure 12 of the air handling unit 10, leaving only the hood 36 exposed, being in this position generally coplanar with the wall 27B. The economizer assembly 30 is closely received into the enclosure 12 in that there is a substantially small clearance, for example, one inch or less, between the side closure members 38 and the edges defining the assembly aperture 22 in enclosure 12. In this position, air handling unit 10 may be readily shipped as enclosure 12 presents a rectangular box with all components protected in the interior of the enclosure 12.

Upon completion of shipping and installation, the economizer assembly 30 is then pivoted outward to a second position, again as shown in FIG. 1, and secured in a second position by a number of bolts or screws 60. In the second position, the planar exterior hood 36 diverges angularly from the plane defined by wall 27B. The proximate end of hood 36, the distal end of the assembly interior wall 40, and the side closure members 38 sealingly engage the edges defining the assembly aperture 22 in an air flow preventing manner. This prevents an intake of ambient air into the interior of the air handler other than through the economizer inlet 42 and the passage defined in the economizer assembly 30, so that undesirable uncontrolled mixing of return air and ambient air cannot occur.

A perspective view of the economizer assembly 30 is more clearly shown in FIG. 3. This is a partially exploded view of the air handling unit 10, showing a side wall 27A of enclosure 12 removed for clarity. The position of pivot pin 32 is clearly set forth in relation to the enclosure side panel 12. Heat exchange coil 14 and filter 15 are disposed angularly within enclosure 12 adjacent to economizer assembly 30, and are angled such that economizer assembly 30 is accepted into enclosure 12 without contacting or interfering with filter 15. This disposition of the air handling equipment within the air handling unit 10 may be modified in alternative embodiments, provided that no substantial interference occurs between the economizer assembly 30 and the air handling equipment.

The economizer assembly aperture 22 is sized to closely accept side closure members 38 and hood 36, thereby presenting a relatively flat surface. A skirted return air intake 24 is shown disposed on a lower panel of enclosure 12. The skirted return air intake 24 cooperates with return air ductwork of a structure (not shown) upon which the air handler unit 10 is disposed to deliver return air into enclosure 12.

Figure 4:
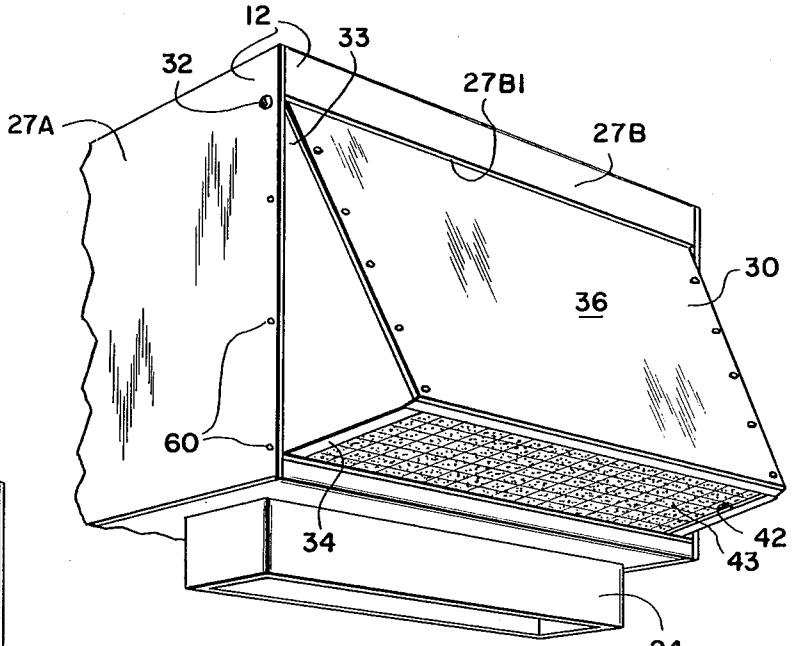
FIG. 4 shows a perspective view of the economizer in an second position.

A perspective view of the completed economizer assembly 30 installation in a second position is shown in FIG. 4. Economizer filter 43 is exposed to permit the intake of makeup air or free-cooling air through the economizer assembly 30 or for the exhaust of return air through the economizer assembly 30. The economizer assembly 30 is pivoted to a second position and secured therein by a number of bolts or screws 60 disposed through apertures in enclosure 12 to securely, sealingly engage hood side members 38, which are exposed at the opposite sides of hood 36. The primary damper blade assembly 50, secondary damper blade assembly 55, and assembly interior wall 40 are not visible in this view, as they remain disposed within the enclosure 12.

Figure 5:
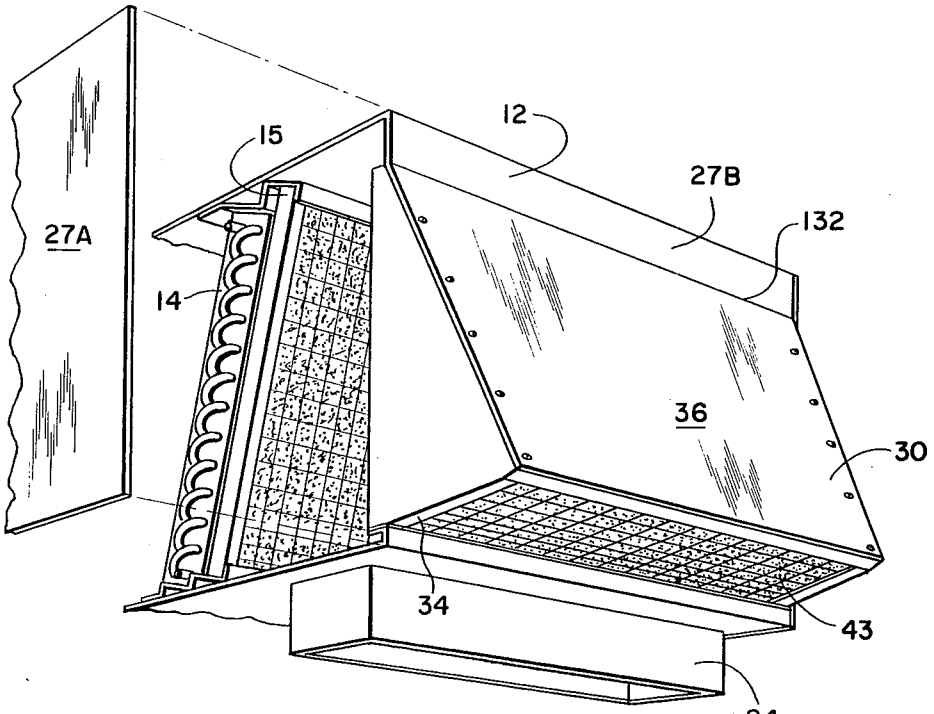
FIG. 5 shows an exploded partial perspective view of an alternative embodiment of the economizer.

An alternative embodiment of the subject invention is shown in FIG. 5. An air handling enclosure 120 is shown with an economizer assembly 130 disposed therein. A bendable pivot portion 132 is disposed at the proximate end of an economizer hood 136 to pivotally secure the economizer assembly 130 to the air handling enclosure 120. The bendable pivot portion 132 may alternatively be a portion of the top or wall of the enclosure 120, and as such, is immovably mounted to the enclosure 120. The use and operation of the alternative embodiment is substantially the same as that of the preferred embodiment, however, the pivot pin 32 therein is replaced by the bendable pivot portion 132 in the alternative embodiment.

In another alternative, the assembly aperture 22 may be defined by the enclosure walls 27A, the enclosure top 28 and the enclosure bottom 29. In this embodiment, the economizer assembly 30 comprises the whole of the wall 27B. Other aspects of this embodiment remain consistent with the preferred embodiment.

In operation, the economizer is shipped with the air handling unit 10 in the first position. The economizer assembly 30 is secured in the first position by securing means such as bolts or screws 60, and comprises a relatively flat, substantially planar end. The air handling unit 10 is shipped in a crate, or upon a truck, as dictated by the size of the air handling unit 10. The unit 10 is handled by cranes utilizing chains or cables or other conventional lifting means without special requirement for protection of the economizer assembly 30, as the assembly 30 is protected within enclosure 12.

Once the air handling unit 10 is sited and secured, the bolts or screws 60 securing the economizer assembly in the first position are removed and the economizer assembly 30 is simply pivotally extended to an open or second position and secured therein by bolts or screws 60. Separate shipment of the economizer assembly 30 is unnecessary, and the internal components of the air handling unit 10, such as filter 15 and heat exchanger coil 14 are protected by the hood 36 of the assembly 30, avoiding the requirement of an extra removeable panel on enclosure 12 for shipping protection of those components, while simultaneously avoiding a second shipment and field installation of an economizer assembly 30.

Thus, it can be readily appreciated that the pivoting economizer assembly 30 provides an inexpensive means for shipment of an air handling unit 10 with an economizer assembly 30, while providing increased protection for both economizer assembly 30 and the internal components of the air handling unit 10. In addition, the integral nature of the economizer assembly 30 greatly simplifies field installation of air handling unit 10, reducing installation time and the opportunity for installation errors and thereby contributing to greater installation efficiency and accuracy. It can readily be seen that the subject invention provides substantial advantages over the known prior art.

Modifications to the preferred embodiment of the subject invention will be apparent to those skilled in the art within the scope of the claims that follow hereinbelow.

I claim:

1. An air handler comprised of:

an enclosure having a wall, said wall including edges defining an aperture through said wall;

an economizer assembly pivotally mounted to said enclosure, said assembly being positionable between a first position wherein a portion of said assembly is disposed within said aperture in said wall, and a second position wherein said assembly extends from said wall, said economizer assembly further comprised of a generally planar hood member, said hood member having a proximate end for pivotal mounting, a distal end, and two respectively opposite sides extending between said proximate end and said distal end, two side closure members, each of said side closure members attached to one of said respective opposite sides of said hood and extending through said aperture in said wall when said economizer assembly is in the first position, each said side closure member having a proximate end and a distal end, and an assembly interior wall having a proximate end adjacent said hood approximate end, a distal end, and two respectively opposite sides extending between said proximate end and said distal end, each said respective side attached to one of said side closure members whereby said hood member, said assembly interior wall, and said side closure members cooperate to defining a passage for the flow of air through said economizer assembly;

means for selectively securing said economizer assembly in said first position and said second position.

2. The air handler as set forth in claim 1 wherein said wall and said hood member further comprise a generally planar surface in the first position.

3. The air handler as set forth in claim 2 wherein said assembly interior wall of said economizer assembly includes edges defining a damper aperture in said assembly interior wall, said assembly interior wall further having a damper blade pivotally mounted thereon and disposed to selectively control the flow of air from the passage to said enclosure.

4. The air handler as set forth in claim 3 wherein said side closure members, said distal end of said assembly interior wall and said proximate end of said hood member sealingly engage said edges of said wall to comprise an airflow preventing seal of said aperture, whereby said flow of ambient air into said enclosure is accepted only through the passage defined in said economizer assembly.

5. The air handler as set forth in claim 4 wherein said pivotal mounting means is comprised of a pivot pin pivotally adjoining said proximate end of said economizer assembly and one of said edges in said wall.

6. The air handler as set forth in claim 4 wherein said pivotal mounting means is a bendable portion of said hood member.

7. The air handler as set forth in claim 2 wherein said portion of said economizer assembly disposed into said interior includes said side closure members and said assembly interior wall when in the first position.

8. An air handler comprised of:

an enclosure defining an interior for containing air handling equipment, said enclosure having a wall having at least four edges therein for defining a substantially rectangular aperture through said wall;

a positionable economizer assembly, said economizer assembly having a proximate end, a distal end, and two respectively opposite sides corresponding to said rectangular aperture, said economizer assembly further including a generally planar hood, an assembly interior wall, and two side closure members extending therebetween to define a passage for the flow of ambient air therethrough, said respective distal ends of said hood, said assembly interior wall, and said side closure members further cooperating to define a substantially rectangular economizer inlet;

means for pivotally mounting said positionable economizer assembly at said proximate end to said wall positionally between a first position wherein at least said assembly interior wall and said side closure members are disposed through said aperture into said interior in a manner substantially free of interference with said air handling equipment, while said hood member covers said aperture and forms in cooperation with said wall a relatively flat end of said air handler for convenient shipping thereof, and a second position wherein said proximate end of said hood member, said distal end of said assembly interior wall, and said side closure members each sealingly engage in an air flow preventing manner a respective edge of said rectangular aperture and wherein said hood member further angularly diverges from said wall so that said economizer inlet is presented for accepting ambient air into the passage defined in said economizer assembly;

means for securing said positionable economizer assembly alternately in the first position and the second position.

9. The air handler as set forth in claim 8 wherein said pivotal mounting means is further comprised of a pivot pin pivotally engaging said wall and said proximate end of said positionable economizer assembly.

10. The air handler as set forth in claim 8 wherein said pivotal mounting means is further comprised of a bendable portion of said hood member at the proximate end of said economizer assembly, said bendable portion further being adjacent to one said edge of said aperture.

* * * * *